US006654980B2

(12) United States Patent
Biggs

(10) Patent No.: US 6,654,980 B2
(45) Date of Patent: Dec. 2, 2003

(54) SLIDING COLLAR MOP HEAD RETAINER

(76) Inventor: Blyth S. Biggs, 1684 Pine Nut Rd., Gardnerville, NV (US) 89410

( * ) Notice: Subject to any disclaimer, the term of this patent is extended or adjusted under 35 U.S.C. 154(b) by 0 days.

(21) Appl. No.: 09/932,173

(22) Filed: Aug. 17, 2001

(65) Prior Publication Data

US 2003/0037392 A1 Feb. 27, 2003

(51) Int. Cl.[7] ..... A47L 13/20
(52) U.S. Cl. ..... 15/150; 15/178
(58) Field of Search ..... 15/146, 147.1, 15/150, 177, 178, 148, 154; 81/7, 90.2; 269/3, 6, 233–236, 239; 279/35–37

(56) References Cited

U.S. PATENT DOCUMENTS 167,304 A * 8/1875 Clark
RE6,719 E * 10/1875 Seymour
170,525 A * 11/1875 Clark
1,110,605 A * 9/1914 Wilburn
1,478,339 A * 12/1923 Jayne
1,762,920 A * 6/1930 Duce et al.
2,416,228 A * 2/1947 Sheppard
3,605,161 A * 9/1971 Moss
3,813,724 A * 6/1974 Unger
4,006,509 A * 2/1977 Chase
4,691,903 A * 9/1987 Castille

FOREIGN PATENT DOCUMENTS

JP 2001346746 * 12/2001

* cited by examiner

*Primary Examiner*—Terrence R. Till
(74) *Attorney, Agent, or Firm*—Herbert C. Schulze

(57) ABSTRACT

This is a jaws type mop head closure means and method in which a collar slides against inclined arms on mop head jaws in such manner that the jaws are brought together to grip a yarn type mop by sliding the collar in one direction and are allowed to open to release the mop by sliding in a different direction.

1 Claim, 4 Drawing Sheets

SLIDING COLLAR MOP HEAD RETAINER

CROSS REFERENCE TO RELATED PATENT APPLICATIONS

This application is related to my application for Quick Release Mop Head Jaws, Ser. No. 09/932,016 filed Aug. 16, 2001.

BACKGROUND OF THE INVENTION

I. Field of the Invention

This invention is in the general field of mops used in janitorial services;

The invention is more particularly in the field of jaws type retaining and clamping devices for yarn type mops;

The invention is even most particularly in the field of improved, quick release jaws mop head clamping devices.

II. Description of the Prior Art

There has been much prior art in the fields of jaws-type retaining and clamping devices for attaching yarn type mop heads to mop handles. I am aware of U.S. Pat. No. 5,375,286 which is a quick release connector between a mop and mop handle, among others.

There are types of jaws mop heads in which the jaws are actuated by a threaded collar which surrounds a stem which holds the jaws. On screwing the threaded collar down against wedge-like portions of the jaws arms, the jaws are made to come into a firm gripping hold on a mop such that it does not readily become dislodged during vigorous mopping. One difficulty with such jaws mop heads is that screwing the collar down to maximum holding pressure requires either a large wrench, such as a pipe wrench, or extraordinary hand and arm strength. The result is that it is possible for the mop to be not securely fastened by the jaws. Another problem is that a janitor using a mop may have wet and slippery hands making it quite difficult and time consuming to replace mops.

I have studied this problem completely and have examined all examples of mops of this nature, literature, and patents. I found no answer to this problem. Therefore I have now conceived and developed an extremely effective, and easy to use sliding and self locking collar to replace the threaded collar in this type mop head.

Extensive as the prior art in this general field has been, I am unaware of any prior art as to the quick release sliding collar arrangement for jaws type mop heads I have invented. My invention is a sliding collar retainer arrangement which is easily operable by anyone and which requires no tools, special skills, or the like. I do not know of any prior art which teaches or suggests my present invention.

SUMMARY OF THE INVENTION

I have been interested in mops and mopping for some time. One of the things I have worked on is the jaws type mop head where the two jaws pivot outwardly from one another to open and pivot inwardly toward one another to grip the mop. The latching, or closing in position on a mop has been of prime concern. One preferred and widely used mop head of this type has a threaded shank depending toward the mop handle from the jaws within a threaded collar which is screwed onto the shank exerting pressure against wedge like elements on the jaws in order to bring the jaws into secure gripping upon the mop. This requires a great deal of strength, coupled with the inherent problem that one mopping may have wet and slippery hands or gloves making the task even greater. In fact, it is possible to have less than effective gripping of the mop by the jaws because of this.

I have now solved the deficiencies of the prior devices by utilizing a sliding collar device which is easily manipulated by a single individual. The collar uses reliable spring loaded pawl and detent or ratchet mechanisms in order to insure against unintentional failure to properly and securely fasten the jaws upon the mop while at the same time allowing for sufficient ease of fixing the jaws in either locked or unlocked condition as desired.

It is an object of this invention to provide a superior jaws type mop head;

It is another object of this invention to provide a jaws type mop head which has a slidable closure;

Another object of this invention is to provide a closure for a jaws type mop head which will securely hold mops;

Another object of this invention is to provide a jaws type mop head which is easily manipulated by anyone with wet and soapy hands.

The foregoing and other objects and advantages of this invention will become apparent to those skilled in the art upon reading the description of a preferred embodiment, which follows, in conjunction with a review of the appended drawings.

DESCRIPTION OF A PREFERRED EMBODIMENT

Figure 1:
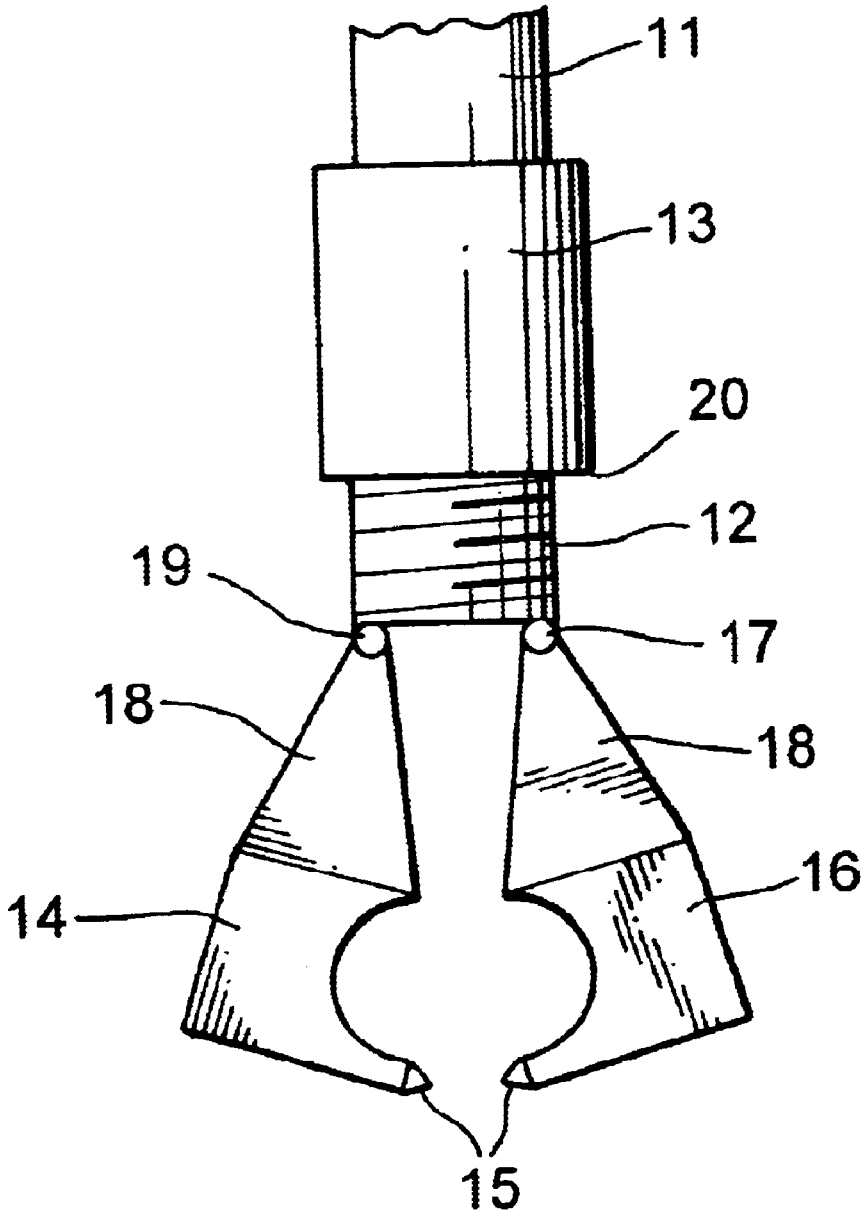
FIG. 1 is a schematic perspective view of a mop head utilizing a threaded collar and shank for opening and closing mop holding jaws with the mop head open.

An inventory of items in the drawings with reference numerals is:

| Numeral | Item |
|---|---|
| 11 | tube for insertion of mop handle |
| 12 | threads on exterior of tube |
| 13 | collar with internal threads |
| 14 | first of two jaws |
| 15 | teeth on jaws |
| 16 | second of two jaws |

-continued

| Numeral | Item |
|---|---|
| 17 | ball and socket |
| 18 | inclined area on jaws shaft |
| 19 | ball and socket |
| 20 | leading edge on threaded collar |
| 21 | shaft to connect mop handle and jaws |
| 22 | flange |
| 23 | ball and socket |
| 24 | first of two jaws |
| 25 | inclined area on jaws shaft |
| 26 | second of two jaws |
| 27 | ball and socket |
| 28 | sliding sleeve |
| 29 | cut out for locking arm |
| 29a | incline area on jaw |
| 30 | locking arm |
| 31 | locking arm anchor |
| 32 | locking arm stop |
| 33 | flange |
| 34 | socket for mop handle |
| 35 | bearing fixed to socket |
| 36 | bolt head |
| 37 | cam |
| 38 | cam actuating arm |
| 39 | sliding collar |
| 40 | jaw |
| 41 | jaw mounting and clamping arm |
| 42 | jaw |
| 43 | jaw mounting and clamping arm |
| 44 | flange |
| 45 | teeth on jaws |
| 46 | mop |
| 47 | leading edge of sliding collar |
| 50 | mop handle connector |
| 51 | sliding collar |
| 52 | jaw |
| 53 | jaw |
| 54 | jaw mounting and clamping arm |
| 55 | jaw mounting and clamping arm |
| 56 | ball and socket mounting |
| 57 | ball and socket mounting |
| 58 | hole in collar |
| 59 | spring loaded ball |
| 60 | lip on collar |
| 61 | mop |

FIG. 1 shows a jaws type mop head comprised of a tube 11 which is suitable to receive a mop handle and which extends to a stem end containing ball and socket arrangements 17 and 19 which are the combinations of sockets with balls or the equivalent on the inclined areas 18 on jaw 16 and a similar area not clearly visible on jaw 14. The jaws have teeth 15 to grip a mop when closed. Threads 12 surround a portion of the tube 11 as shown. Sleeve 13 has internal threads engaged with the external threads on the tub 11. In operation, the sleeve 13 is rotated on the threads until the sleeve end 20 until it bears on the inclined area 18 on jaw 16 and the similar inclined area which is not visible on jaw 14. As the sleeve rotates further toward the jaws it forces the jaws together as will be understood by those skilled in the art. By reversing the rotation of the sleeve 13 the jaws will be allowed to open to release any mop they may be holding. It is very difficult to handle this as it requires great strength or a special wrench. Additionally, the hands tend to slip since they may be wet and soapy.

Figure 2:
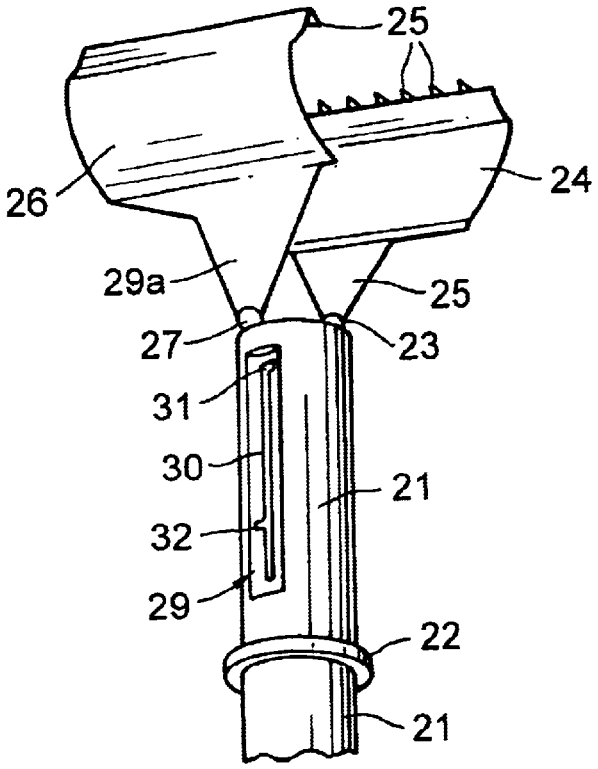
FIG. 2 is a schematic perspective view of a device suitable to practice the method of this invention with the mop head jaws open.
Figure 2A:
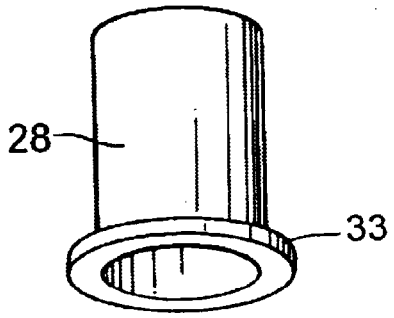

FIGS. 2/2A show a device according to my new invention. Shaft 21 has a removable flange 22 near one end. This end will be suitable to connect to a mop handle. Intermediate the flange 22 and the jaws 24 and 26, the shaft 21 will have a recess 29 as shown. A stop element 32 on control bar 30 is located within the recess 29 and will be moveably mounted to the shaft 21 within the recess at 31. This may be mounted on a swivel or otherwise moveable as will be understood by those skilled in the art. The jaws 24 and 26 having inclined shaft areas 25 and 29*a* are connected to the shaft 21 by customary ball and socket arrangements 23 and 27 as will be understood by those skilled in the art. The sliding collar 28 with flange 33 is shown in FIG. 2A separated from the shaft 21. It will be understood by those skilled in the art that the flange 22 will be temporarily removed in order to place sliding collar 28 with its flange 33 on shaft 21. Flange 2 will be mounted by set screws or the like, not shown, but understood by those skilled in the art. When the sliding collar is in place on shaft 21, and it is desired to close the jaws on a mop, the user can push the collar with the heel of the user's hand against the flange 33. This requires less strength than that required to turn the threaded sleeve as in the past. When the sleeve is in position holding the jaws closed, the locking arm 30 is moved out of the recess 29 and the sliding collar will move away from the jaws allowing them to open.

Figure 5:
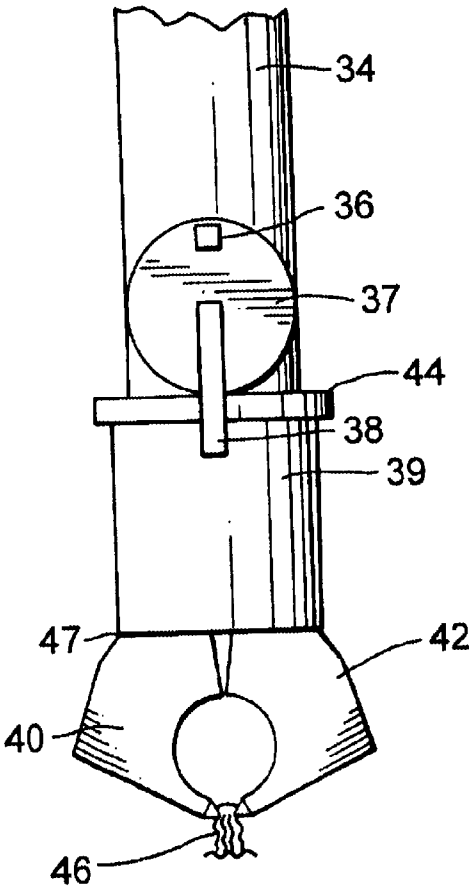
FIG. 5 is a schematic front elevation of the device of FIG. 3 with the jaws closed on a mop.
Figure 4:
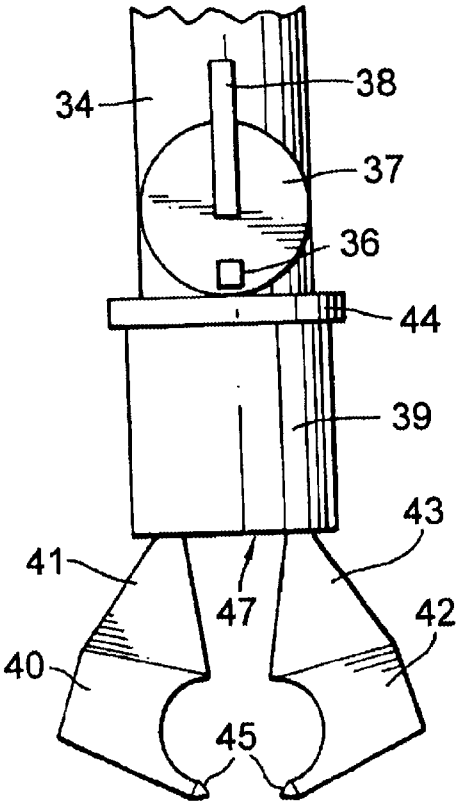
FIG. 4 is a schematic side elevation of the device of FIG. 3 with the jaws open.
Figure 3:
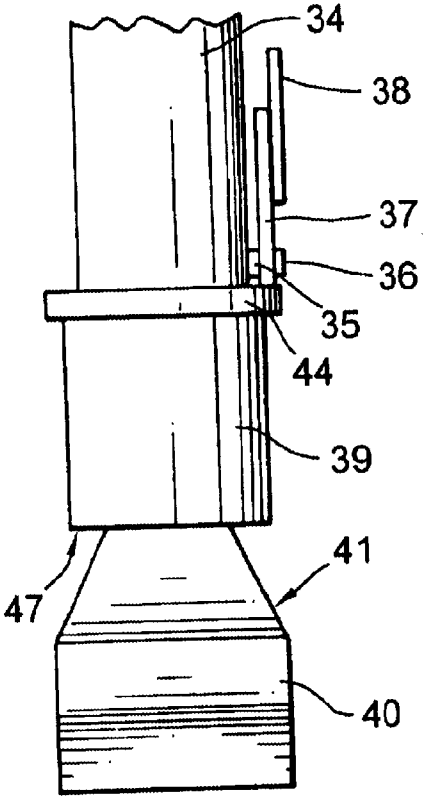
FIG. 3 is a schematic front elevation of an alternate embodiment of a device suitable to practice the method of this invention.

FIGS. 3, 4, and 5 illustrate an alternate embodiment of the sliding collar invention. The three figures are best viewed together. A shaft 34 or the like will be adapted to fit to a mop handle above the broken off line showing in the figures as will be understood by those skilled in the art. What is illustrated is a jaws mechanism actuated by a sliding collar. A collar 39 is slidably mounted on the shaft 34. Preferably the collar will have a flange 44 about its upper end. The collar has a leading edge 47 which actuates the jaws by pressure against the inclined jaw mounting and clamping arms 41 and 43. As the leading edge of the collar slides forward against the inclined arms it forces them together. As the collar retracts the jaws are able to separate. I have provide a cam action actuator for the sliding collar in the embodiment of FIGS. 3, 4, and 5. A disk 37 is mounted on shaft 36 which is journaled in a bearing or the like 35 which is fastened to shaft 34 in customary fashion as will be understood by those skilled in the art. Handle 38 is welded or otherwise affixed to disk 37 as shown. When the disc is turned 180 degrees from the position shown in FIG. 4 to the position of FIG. 5 the teeth 45 on the jaws will completely and securely hold a yarn type mop as shown in FIG. 5 where the jaws are in fully closed condition.

Figure 8:
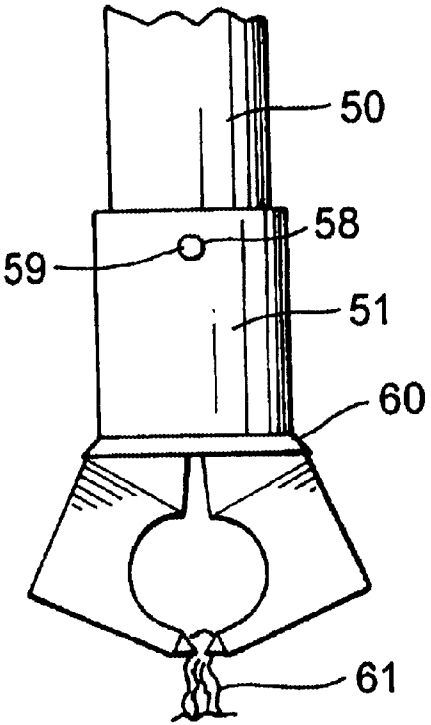
FIG. 8 is a schematic side elevation of the device of FIG. 6 with the sliding collar in position after closing the jaws and with a mop being held by the jaws.
Figure 7:
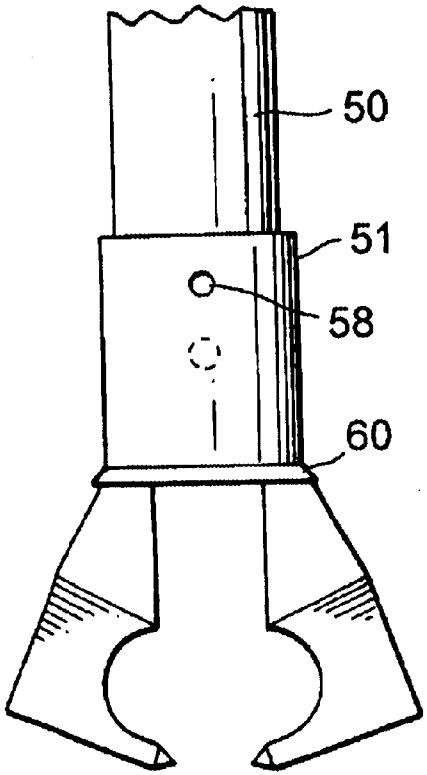
FIG. 7 is a schematic side elevation of the device of FIG. 6 with the sliding collar in position to commence closing the jaws.
Figure 6:
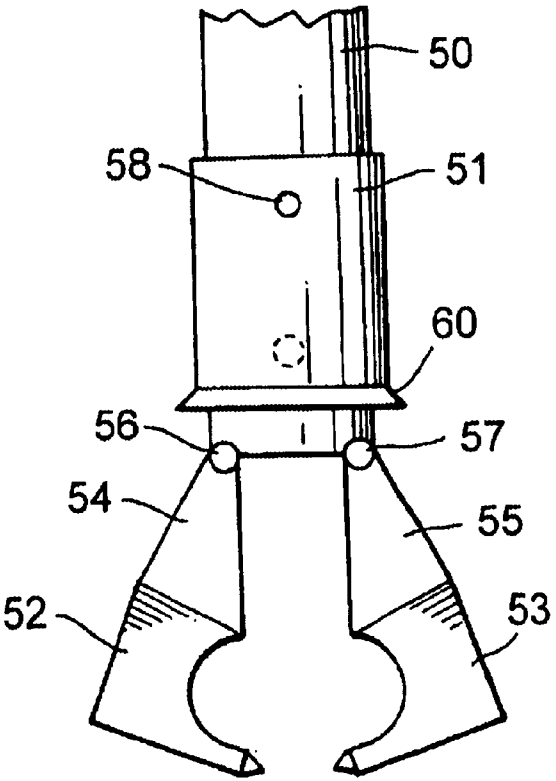
FIG. 6 is a schematic side elevation of another embodiment of a device suitable to practice the method of this invention utilizing a unique sliding collar.

FIGS. 6, 7, and 8 should be viewed together. This final embodiment is deemed most preferable. It is simple and easy to use. The jaws 52 and 53 on inclined arms 54 and 55 are mounted to mop handle adapter 50 by ball and socket type means 56 and 57 as will be known to those skilled in the art. A collar 51 is slidably mounted on adapter 50. The collar may, or may not, have a slightly flared leading edge 60. If the leading edge is flared outwardly from the main body of the collar it may make for easier sliding against the jaws arms 54 and 55. A spring loaded ball or pawl illustrated by the dotted circles 59 on FIGS. 6 and 7 and by the solid black circle on FIG. 8 will hold the collar in position with the jaws fully closed on a mop 61. It is merely necessary to push the ball with a finger to obtain instantaneous opening of the jaws. When the ball is pushed in the collar immediately slides back up the handle adapter 50.

There are great advantages in this method for closing and opening jaws by merely sliding a collar up and down as opposed to turning a threaded collar which cumbersome.

As is known to those skilled in the art, the jaws are generally spring loaded so that they will spring apart, thus saving time and effort.

While the embodiments of this invention shown and described are fully capable of achieving the objects and advantages desired, it is to be understood that such embodiments are shown for purposes of illustration only and not for purposes of limitation.

I claim:

1. A closure for a jaws type mop head comprising: a pair of customary mop head jaws pivotally connected to one another through inclined arms mounted to a holding stem having an axis; a collar with a leading edge which flares outwardly from a main body surrounding said stem slid-ably along said axis; and releasable means to hold said collar in position when the jaws are closed.

* * * * *